US005307870A

United States Patent [19]

Kamiya et al.

[11] Patent Number: 5,307,870

[45] Date of Patent: May 3, 1994

[54] HEAT EXCHANGER

[75] Inventors: Sadayuki Kamiya, Kariya; Satoshi Matsuura, Takahama; Mitsugu Nakamura, Kariya; Norimasa Baba, Nagoya; Eiichi Torigoe, Kariya; Teruhiko Kameoka, Anjo; Ken Yamamoto, Obu; Michiyasu Yamamoto, Chiryu; Ryouichi Sanada, Obu, all of Japan

[73] Assignee: Nippondenso Co., Ltd., Kariya, Japan

[21] Appl. No.: 987,734

[22] Filed: Dec. 8, 1992

[30] Foreign Application Priority Data

Dec. 9, 1991 [JP] Japan ..... 3-324138
Mar. 24, 1992 [JP] Japan ..... 4-66122
May 13, 1992 [JP] Japan ..... 4-120504

[51] Int. Cl.[5] ..... F24F 09/02
[52] U.S. Cl. ..... 165/173; 165/153
[58] Field of Search ..... 165/153, 173, 109.1, 165/907

[56] References Cited

U.S. PATENT DOCUMENTS 4,805,693 2/1989 Flessate ..... 165/153
4,938,284 7/1990 Howells .
5,076,354 12/1991 Nishishita ..... 165/146
5,092,398 3/1992 Nishishita et al. .
5,152,339 10/1992 Calleson ..... 165/173
5,236,044 8/1993 Nagasaka et al. ..... 165/176

FOREIGN PATENT DOCUMENTS 39561 2/1990 Australia .
63-105400 5/1988 Japan .
8617 of 1903 United Kingdom ..... 165/177

OTHER PUBLICATIONS

Journal of Nippondenso Technical Disclosure, No. 69-154, Jan. 15, 1990.

*Primary Examiner*—Allen J. Flanigan
*Attorney, Agent, or Firm*—Cushman, Darby & Cushman

[57] ABSTRACT

A header has a tank member having a transverse cross-section of a circular arc shape, and a tube attachment member having a transverse cross-section flatter than the above-mentioned circular arc shape as a whole, are opposed and joined. The tube attachment member has identical curvature portions constituted with an inner diameter R2 which is the same as the inner diameter R2 of the tank member at both sides to be joined to the tank member, and has a large curvature portion constituted with an inner diameter R1 which is larger than the inner diameter R2 of the tank member at an intermediate portion interposed between the identical curvature portions. A connecting position P between the identical curvature portion and the large curvature portion is inside from both edges of a tube.

5 Claims, 11 Drawing Sheets

HEAT EXCHANGER

BACKGROUND OF THE INVENTION

The present invention relates to a header structure of a heat exchanger for radiators, condensers and the like.

As a header structure of a conventional heat exchanger, there is for example, a structure described in Japanese Patent Laid-open No. 105400-1988. This header structure is characterized by a tank member having a transverse cross-section formed in a circular arc shape and a flat tube attachment member. The tank member and plate member are joined by brazing.

In addition, there is a header structure described in Journal of Nippondenso Technical Disclosure No. 69-154 (issued on Jan. 15, 1990). In the header structure, a tank member having a transverse cross-section of a circular arc shape and a tube attachment member having a transverse cross-section of a circular arc shape are combined to constitute a cylindrical header. A brazing material is poured into an inner peripheral face of a joining portion between the tank member and the tube attachment member in order to have a smooth finish. The concentration of stress at the joining place is prevented by making smooth the inner peripheral face of the joining portion.

However, there is a problem that either one of the above-mentioned former and latter header structures is not well suited to be used as a condenser or a radiator of the condensation type for which high pressure resistance is required. For example, in the former header structure, not only is the tube attachment member flat and has poor pressure resistance, but the stress is concentrated at the joining portion which is bent at an acute angle between the tank member and the tube attachment member. Therefore, no sufficient pressure resistance is obtained with the above-mentioned applications by the former header structure.

On the other hand, since the header is constructed in a cylindrical shape in the latter header structure, pressure resistance which is basically higher than that of the former is obtained; however, production is difficult due to the fact that the brazing material is poured into the inner peripheral face of the joining portion to make the inner peripheral face smooth, and there is the possibility that the brazing material is not supplied sufficiently and brazing deficiency may take place. If brazing is deficient, the strength is lowered and the cylindrical header must be formed in a larger size.

SUMMARY OF THE INVENTION

An object of the present invention is to solve the above-mentioned problems and provide a header structure of a heat exchanger which is easy to produce and has high pressure resistance.

The header structure of the heat exchanger of the present invention has a structure allowing a refrigerant to flow in and out with respect to a tube, characterized in that said header has the constitution such that a longitudinal tank member which has a transverse cross-section of a circular arc shape and a longitudinal tube attachment member which has a transverse cross-section flatter than said circular arc shape as a whole are opposed and joined in the longitudinal direction, said tank member is provided with a thin layer of brazing material provided at least at a joining face with respect to said tube attachment member, and a plane portion of a minute height formed at an inner peripheral face adjacent to the joining face with respect to said tube attachment member, said tube attachment member is provided with a thin layer of brazing material provided at least at a joining face with respect to said tank member, a plane portion of a minute height formed at an inner peripheral face adjacent to the joining face with respect to said tank member, an identical curvature portion which, is formed in the vicinity of the joining face with respect to said tank member and has a curvature approximately the same curvature as that of said tank member, and a large curvature portion which is formed at a central portions interposed between both identical curvature portion and has a curvature larger than the curvature of said tank member, and a connecting position between said identical curvature portion and said large curvature portion is set inside the attaching region of the tube to be attached to the tube attachment member.

In the above-mentioned constitution, the thin layer of brazing material is provided at the joining face of the tank member and the joining face of the tube attachment member, so that the brazing material is sufficiently supplied to the joining face during the joining of both members, and the brazing joint is complete. In addition, the inner peripheral face at the connecting place between the tank member and the tube attachment member is connected smoothly by means of the plane portion of minute height. Namely, the dispersion in the shape of the tank member and the tube attachment member generated during processing may change the shape of the inner peripheral face at the connecting place, however, the inner peripheral face adjacent to the connecting face is the plane portion of minute height, so that the dispersion in shape cannot cause disappearance of smoothness of the inner peripheral face. Therefore, a large stress concentration is not generated at the connecting place.

Further, the tube attachment member is constituted by the identical curvature portions at both sides and the large curvature portion interposed therebetween, so that it has a shape flatter than the tank member as a whole. The connecting position between the identical curvature portions and the large curvature portion is set inside of the attaching region of the tube, so that the disadvantage in strength presented by the shape of large curvature portion is dissolved by the fact that the tube itself functions as a structural member. Therefore, the header in which the tank member is joined to the tube attachment member exhibits high pressure resistance and is still compact.

As described above, the header structure having the above-mentioned construction is easy to produce and has high pressure resistance.

DETAILED DESCRIPTION OF THE PREFERRED EMBODIMENTS

Figure 1:
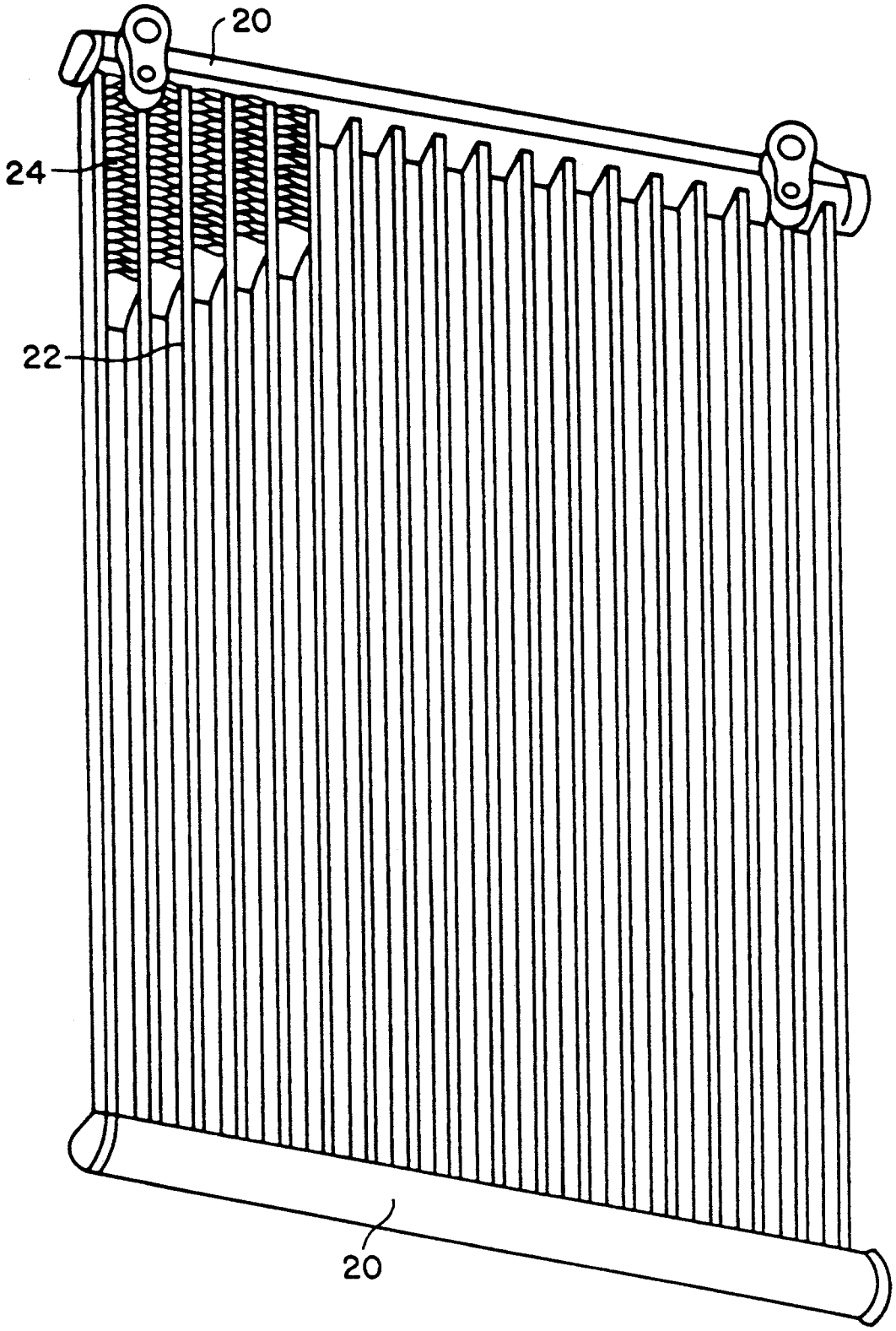
FIG. 1 is a perspective view of a condenser.

FIG. 1 shows an entire view of the condenser. The headers 20 are provided at both sides of a core comprising a tube 22 and fins 24.

The header 20 has the following constitution.

Figure 2:
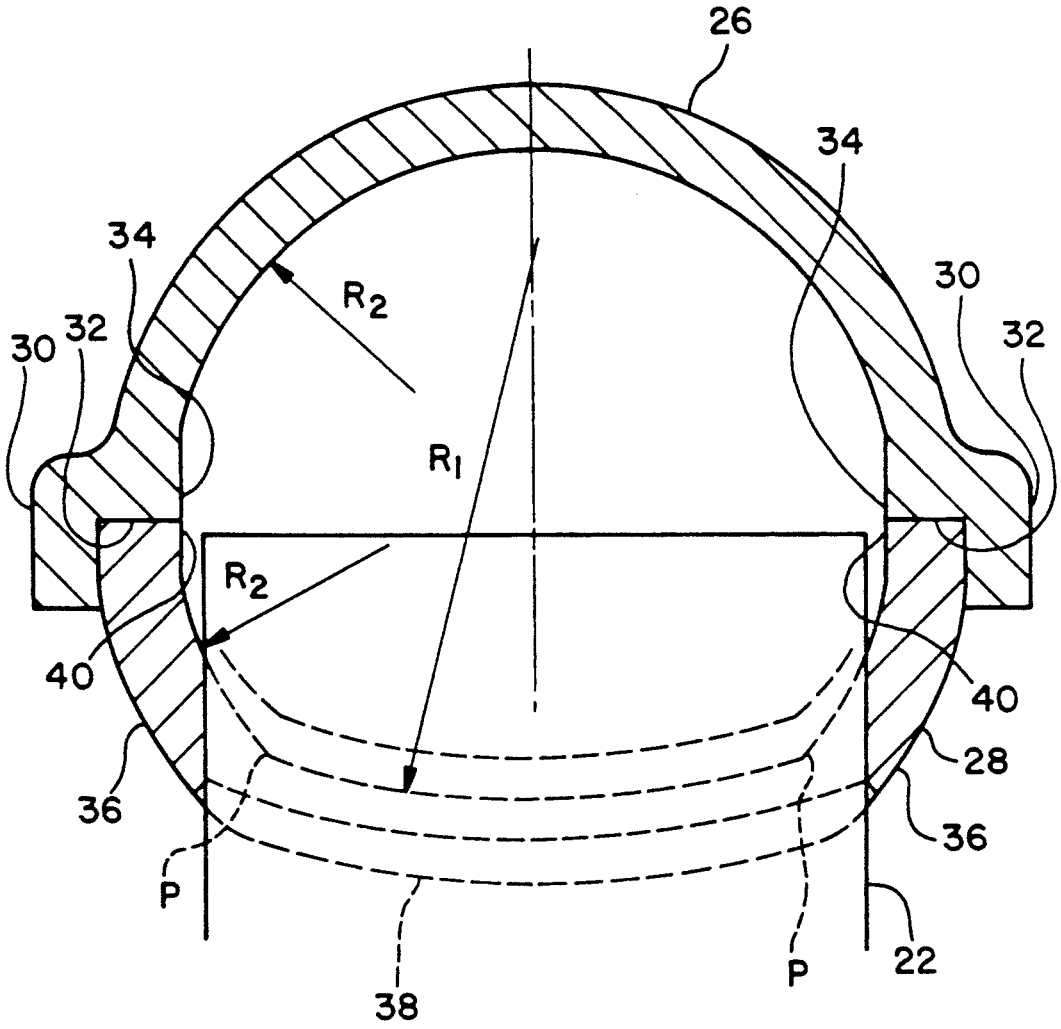
FIG. 2 is a cross sectional view of a header taken vertically to an axis.
Figure 3:
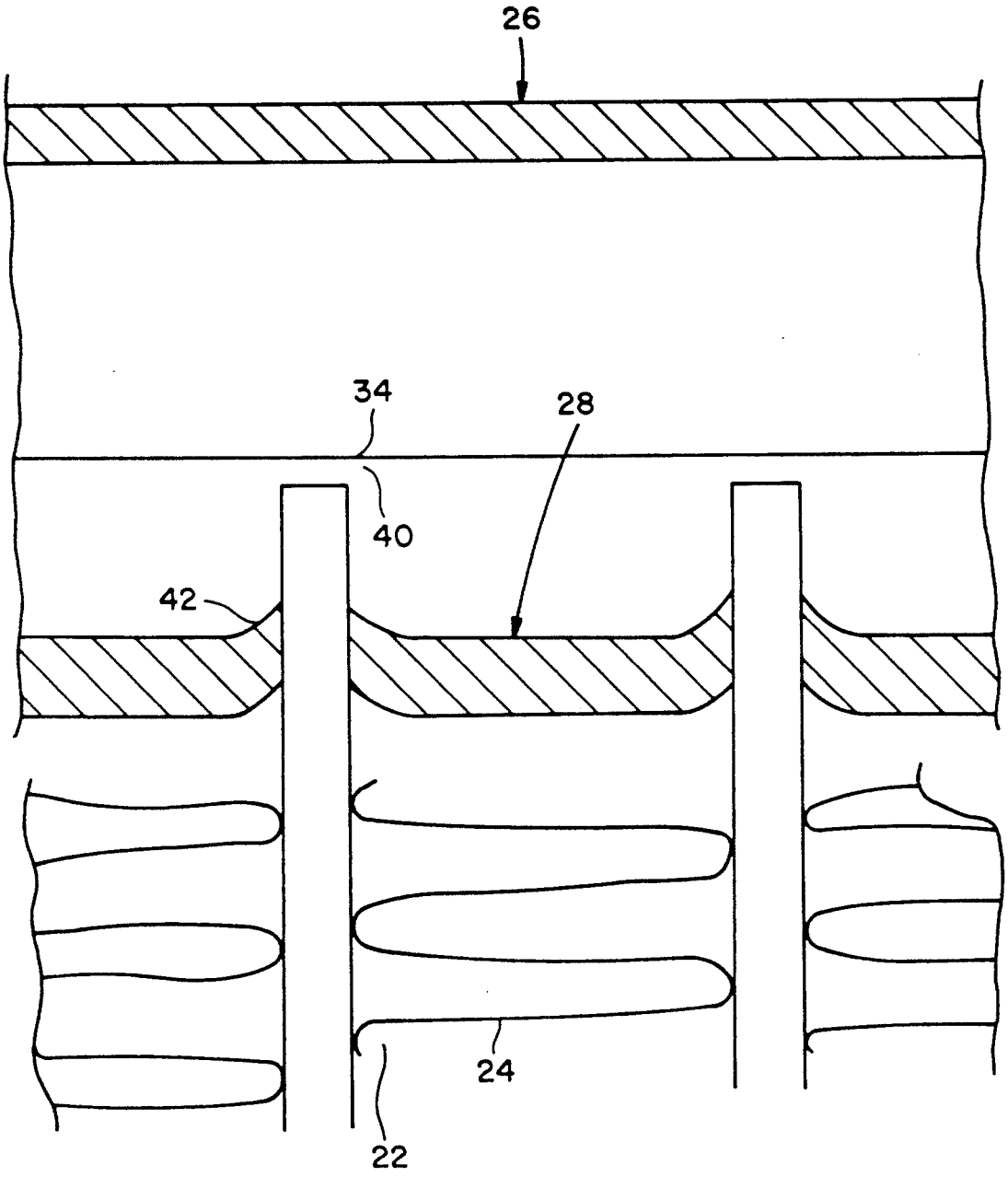
FIG. 3 is a partial cross sectional view of a header taken parallel to the axis.

As shown in a transverse cross-sectional view of FIG. 2, the header 20 has the constitution in which a longitudinal tank member 26 which has a transverse cross-section being shaped in a circular arc and a longitudinal tube attachment member 28 which has a transverse cross-section flatter than the above-mentioned circular arc shape as a whole are opposed and joined in the longitudinal direction.

The tank member 26 has a semi-cylindrical shape in which an inner peripheral face a radius R2 which is approximately half of a width of the tube 22, which is provided with clamp portions 30 at the right and left. A joining face 32 having a sharp bend is formed at the inside of the clamp portion 30. A plane portion 34 having a minute height is formed at an inner peripheral face adjacent to the joining face 32. The height of the plane portion 34 is desirably not less than 1 mm from a production viewpoint, however, it is designed to be of a minute height within a range which will not deteriorate the cylindrical shape. The tank member 26 is composed of an aluminum clad material, and a clad layer of a brazing material is formed at both inside and outside faces. The tank member 26 is manufactured by the press forming or the roll shaping (high pressure roll shaping) process.

The tube attachment member 28 has identical curvature portions 36 having an inner diameter R2 which is the same as the inner diameter R2 of the tank member 26 at both of the sides to be joined to the tank member 26, and has a large curvature portion 38 constituted with an inner diameter R1 which is larger than the inner diameter R2 of the tank member 26 at an intermediate portion interposed between the identical curvature portions 36. Therefore, the large diameter curvature portion 38 protrudes a little toward the side of fins 24. The connecting position P between the identical curvature portions 36 at both sides and the intermediate large curvature portion 38 is disposed inwardly with respect to both edges of the tube 22. A plane portion 40 having a minute height is formed at an inner peripheral face adjacent to a joining face opposing to the joining face 32 of the above-mentioned tank member 26. The height of the plane portion 40 is desirably not less than 1 mm from a production viewpoint in the same manner as the above-mentioned plane portion 34; however, to be designed as a whole in a minute height within a range not to deteriorate the inner diameter R2 of the identical curvature portion 36. Further, a hole 42 having a tapered shape for inserting the tube 22 is formed by press forming at an intermediate portion of the tube attachment member 28. The material of the tube attachment member 28 is composed of an aluminum clad material, and a clad layer of a brazing material is formed at both inside and outside faces. A plate with a thickness being equal to or thicker than the plate thickness of the above-mentioned tank member 26 is used. This is to make up for the strength of the tube attachment member 28 which becomes weaker than that of the semi-cylindrical tank member 26 on account of its shape. This tube attachment member 28 is manufactured by press forming or roll shaping.

The header 20 as described hereinbefore is assembled as follows. First, both sides of the tube attachment member 28 are gripped by the clamp portions 30 over both sides of the tank member 26 so as to temporarily fasten the tank member 26 and the clamp portions 30. Then, the tube 22 is inserted into the hole 42 of the tube attachment member 28.

Next, integral brazing is performed in a furnace. By doing so, the clad layer of the brazing material is melted, and the tank member 26 is joined with the tube attachment member 28, and the tube attachment member 28 is joined with the tube 22. Since the brazing material at the clad layer is melted and flows into the joining place, the brazing material is sufficiently supplied to the joining face, the brazing being performed satisfactorily.

In the assembled header 20, the inner peripheral face at the connecting place between the tank member 26 and the tube attachment member 28 is smoothly connected by the plane portions 34 and 40 having a minute height. In other words, the dispersion in shape of the tank member 26 and the tube attachment member 28 generated during processing may cause a change in shape of the inner peripheral face at the connecting place, however, the inner peripheral face adjacent to the joining face is the plane portions 34 and 40 having a minute height, so that the dispersion in shape cannot remove the smoothness of the inner peripheral face. As a result, no large stress concentration acts on the connecting place.

Further, the tube attachment member 28 has identical curvature portions 36 on both sides and the large curvature portion 38 interposed therebetween, so that it has as a whole, a shape flatter than that of the tank member 26. The connecting position between the identical curvature portion 36 and the large curvature portion 38 is set inside the attachment region of the tube 22, so that the disadvantage in strength due to the shape of the large curvature portion 38 is overcome by the fact that the tube itself functions as a structural member. Therefore, the header 20 in which the tank member 26 is joined to the tube attachment member 28 has a high pressure resistance and is still compact.

According to the header structure as explained above, the production can be performed easily and reliably only by integral brazing in the furnace.

In addition, inviting without inviting the stress concentrated at the joining place, high pressure resistance utilizing the characteristics of the cylindrical shape can be obtained.

Further, because the header 20 maintains sufficient refrigerant flow passage, the refrigerant pressure loss is restricted and the core heat transfer area becomes large, making it possible to realize improvement in performance.

Additionally, even with such improvement in performance, the header 20 has reduced height and is compact, so that there is an advantage that the dead space becomes small.

The present invention is not limited to the above embodiment, which can be of course carried out in various embodiments can be varied within the scope of the present invention. For example, the present invention may be applied to a radiator of the condensation type which requires high pressure resistance. The thin layer of the brazing material to be formed for the tank member and the tube attachment member may be formed by flame coating.

Figure 4:
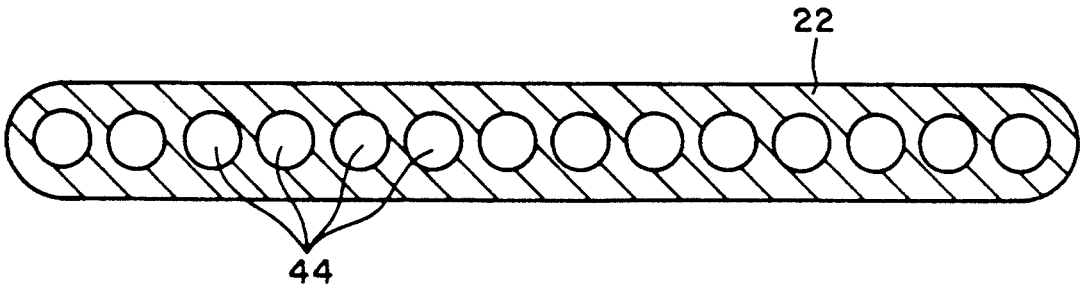
FIG. 4 is a cross sectional view of a tube.

The tube 22 is an extrusion molded article of aluminum, in which a plurality of fluid passages 44 allowing a refrigerant to pass are formed in its interior as shown in FIG. 4. A plurality of fluid passages 44 are provided lined up in a single line, and all cross-sections of the fluid passages 44 are circular. The, an inner diameter dc of the fluid passage 44 is a obtained by subtracting a wall thickness dt of the tube 22 considering the corrosion resistance of a refrigerant condenser from a thickness Dt of the tube 22, that is dc=Dt - 2 dt (see FIG. 5). For example, when Dt=1.7 mm and dt=0.35 mm, then dc=1.0 mm.

The outer fin 24 is a roller-shaped article in which a thin aluminum plate is processed into a wave shape, and at a portion of both faces where the air flows is formed a louver for enhancing the heat exchange efficiency (not shown).

Next, the operation of the above embodiment will be explained.

Figure 5:
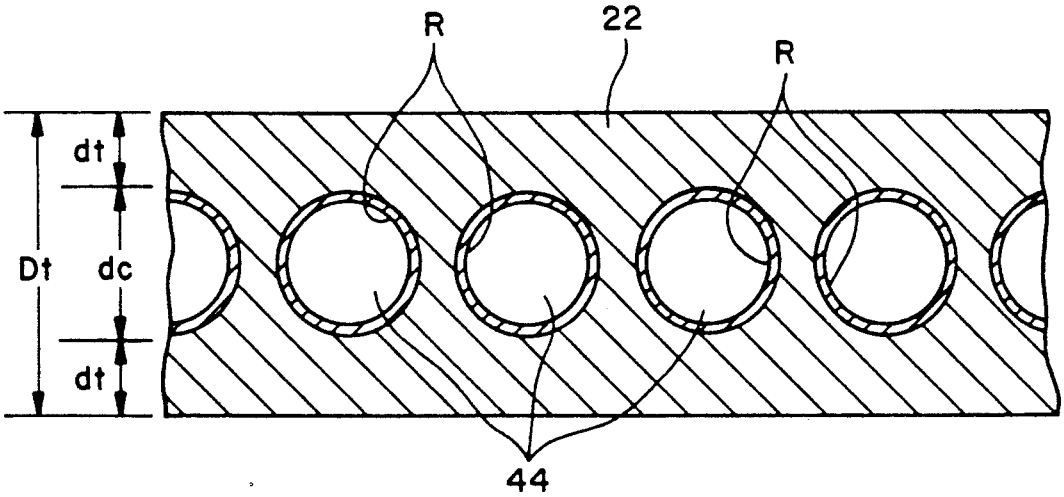
FIG. 5 is an enlarged cross sectional view of the tube.

During a refrigeration cycle, and a gas refrigerant at a high temperature and high pressure is supplied to the inside of the header 20. The refrigerant flowed into the inside of the header 20 is distributed into each tube 22 and flows in each fluid passage 44 of the tube 22; and the refrigerant flowing in the fluid passage 44 performs heat exchange with the air passing between each tube The refrigerant flowing in the fluid passage 44 is cooled after being heat exchanged with air and then is liquefied. As shown in FIG. 5, since the fluid passage 44 through which the refrigerant flows has a true circular cross-section, the liquid refrigerant R is not collected at a part of the inner wall of the fluid passage 44. It flows in the fluid passage 44 in a homogeneous film state. The refrigerant, having been liquefied and condensed after passing through the tube 22, is introduced into the header 20 which communicates with the outlet piping (not shown) and outflows therefrom.

The liquid refrigerant is not collected at a part of the inner wall of the fluid passage 44, but instead it flows through the inner wall of the fluid passage 44 approximately uniformly, preventing it from being collected at a part of the inner wall of the fluid passage 44 which would cause a decrease in the heat exchange efficiency, as in the prior art. As compared with the prior art, the heat exchange efficiency of the refrigerant flowing in the fluid passage 44 increases, which results in an increase in the refrigerant condensation ability of the condensor.

In addition, the cross-section of the passage of the fluid passage 44 is a true circle having no convex or concave portion as compared with a conventional fluid passage, so that the flow resistance of the refrigerant is small. Therefore, the pressure loss of the refrigerant flowing in the fluid passage 44 becomes small as compared with the conventional one, consequently decreasing the pressure loss in the heat exchanger.

In the above-mentioned embodiment, the tube is formed by extrusion. However, a tube whose fluid passage is a circular hole may also be formed by other techniques, such as by joining divided tubes, or by to form a tube a plurality of circular pipes to form a tube and the like.

The embodiment described is a heat exchanger used for the refrigerant condenser in automobiles, however, it can be applied, of course, to refrigerant evaporators for automobiles, as well as to refrigerant condensers of the refrigeration cycle and refrigerant evaporators to be used for domestic use, and it can be applied to heat exchangers for various applications in which the fluid flowing in a tube is heated or cooled by heat transmitted to the tube, such as radiators, oil coolers, heater cores and the like.

The cross-section of the circular hole of the fluid passage does not have to be a true circle. It may have a circular shape such as an ellipse, an elongated circle and the like.

All of the fluid passages in the tube do not have to be circular holes, they may also have holes of other shapes.

A tube having an oblate shape has been shown, however, those tubes having an external form of shape fitting the purpose of use may be used.

The fluid passages of the tubes 22 are lined up in a single line however, they may be arranged in a zigzag manner, or lined up in a plurality lines.

Figure 6:
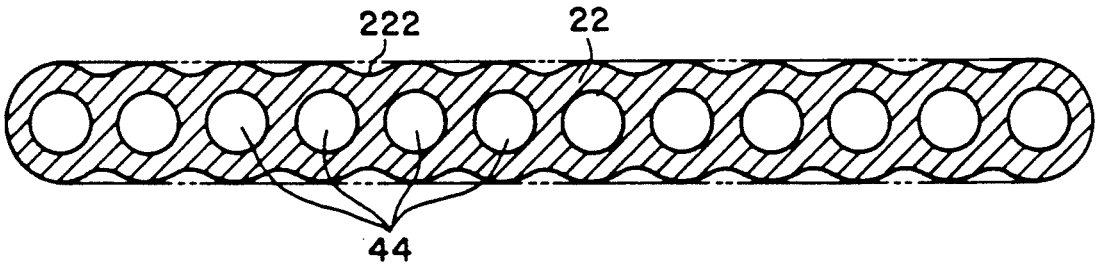
FIG. 6 is a cross sectional view of a tube.
Figure 7:
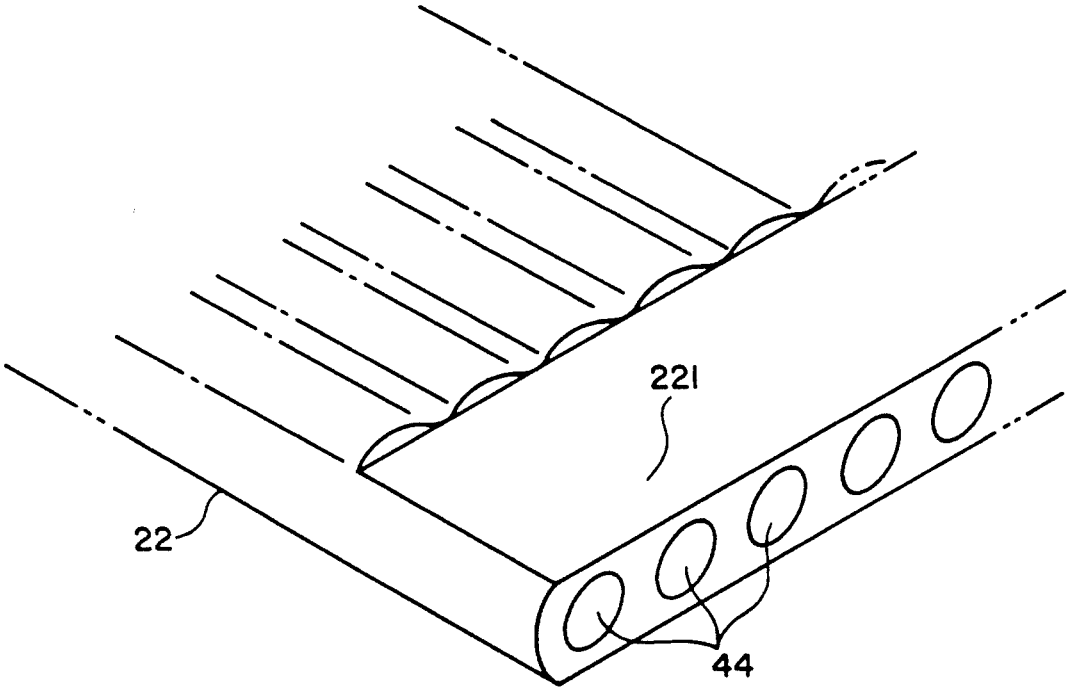
FIG. 7 is a partial perspective view of the tube.

FIG. 6 shows a modified tube 22 of which surface 222 is waved corresponding to the periphery of the fluid passages 44, whereby the amount of the material of the tube 22 is reduced. At the ends of the tube 22, a flat surface 221 is formed so as to be inserted into the header 20.

Figure 8:
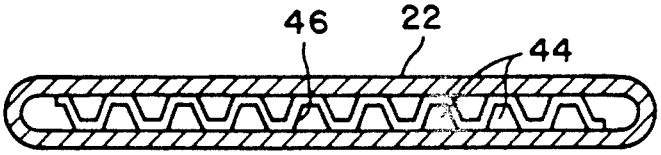
FIG. 8 is a cross sectional view of a tube.

A tube 22 may be used which is made by folding an aluminum plate cladded with brazing material at both faces to make its cross-sectional shape an elongated circle, both end portions being joined by welding, and after inserting an inner fin 5 (described hereinafter) into the interior, is joined by being brazed. (FIG. 8 is a cross-sectional view of the tube 22).

The inner fin 46 is manufactured in a wave shape by press forming or roll shaping using a bare material of aluminum. A peak portion and a valley portion having a U- shaped cross-section are alternately repeated with a predetermined pitch, being a so-called offset inner fin in which the peak portion and the valley portion are deviated in a zigzag manner at certain intervals with respect to the direction of the passage formed by the peak portion and the valley portion. This inner fin 46 is inserted into the tube 22 and forms a plurality of fluid passages 44 in the tube 44 as shown in FIG. 8 by brazing and joining each outer face of the peak portion and the valley portion to an inner wall face of the tube 22. Each of the fluid passages 44 also have a large number of communication holes 48 formed by deviating the peak portion and the valley portion of the inner fin 46 in a zigzag manner as shown in FIG. 9.

Figure 10:
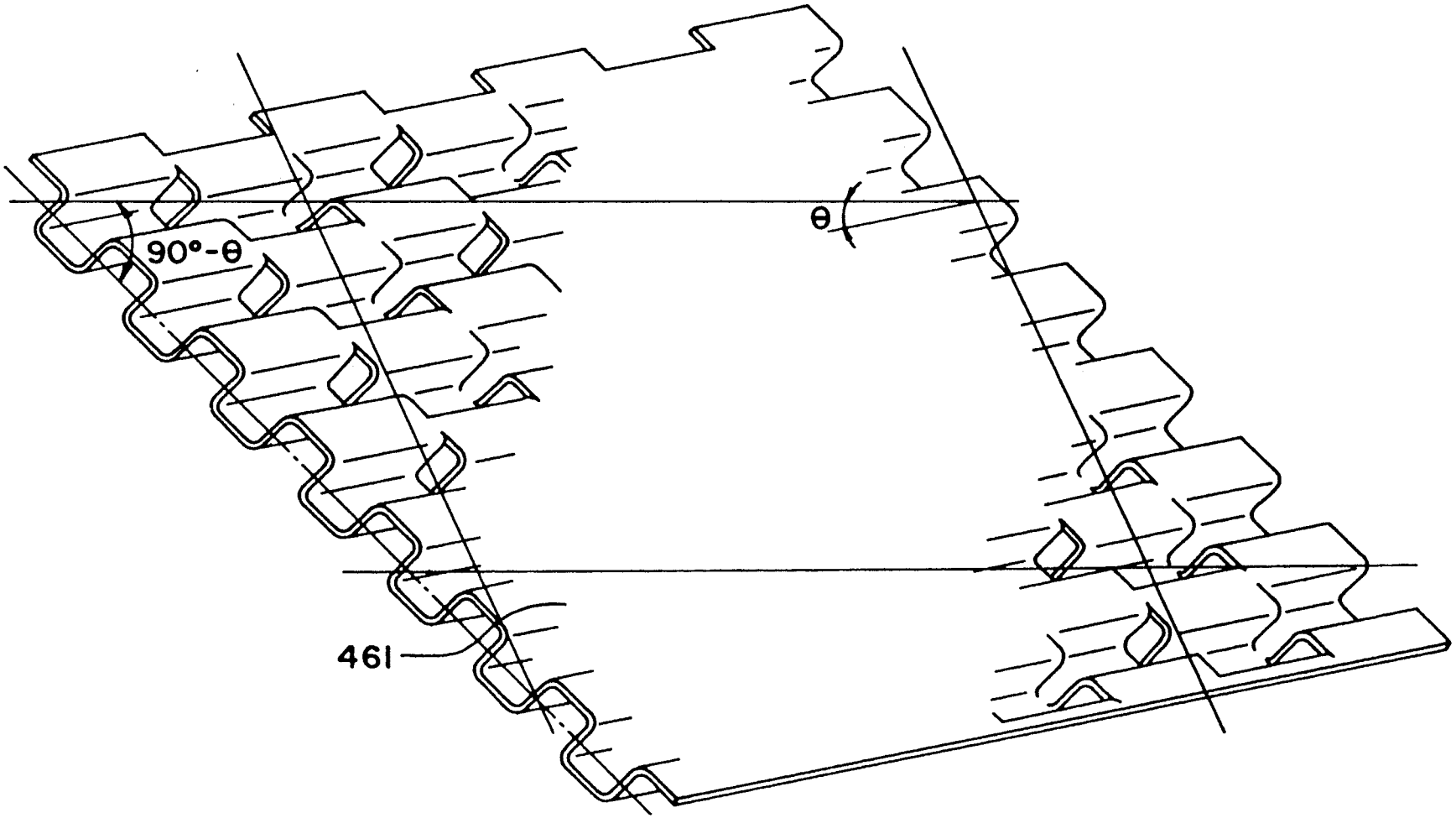
FIG. 10 is a perspective view of the inner fin for showing a method of making the same.

Further, each of the fluid passages 44 has an inclination of a predetermined angle $\theta$ with respect to the longitudinal direction of the tube 22, as shown in FIG. 10 (a perspective view showing the inner fin 46). An inner fin 46 is formed by a fin plate 461 subjected to offset shaping.

Figure 9:
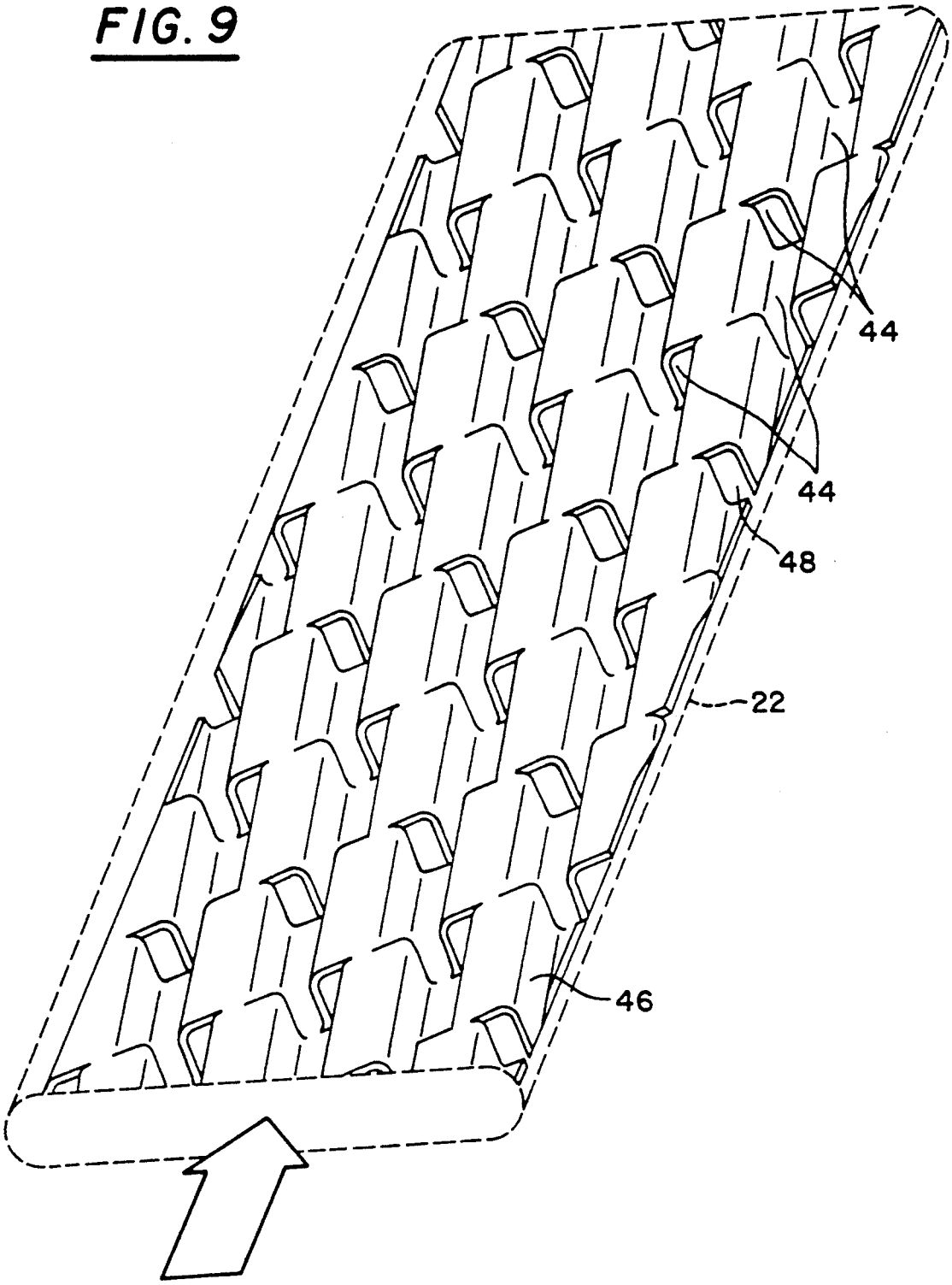
FIG. 9 is a perspective view of an inner fin.

This obliquely cut inner fin 46 is inserted into the tube 22, as shown in FIG. 9. Each of the refrigerant passages 44 formed in the tube 22 therefore has a predetermined angle $\theta$ with respect to the longitudinal direction of the tube 22, and each of the refrigerant passages 44 becomes communicated also in the longitudinal direction of the tube 22 by means of a large number of communication holes 48.

In this case, the refrigerant flowing inside the tube 22 flows through a plurality of fluid passages 44 formed in the tube 22 by the inner fin 46, and passes through a large number of communication holes 48 and also flows in the longitudinal direction of the tube 22. Because the refrigerant flows meandering inside the tube 22, the refrigerant is disturbed by force in the tube 22, and hence the refrigerant flowing in the tube 22 does not flow parallel along the longitudinal direction of the tube 22 between both headers 20, but instead becomes positively mixed.

As a result, when the refrigerant flowing in each tube 22 is cooled and liquefied by the heat exchange with air through the corrugated fin 24, the liquefying proceeds uniformly in the frontward and backward directions of the core (the width direction of the tube 22). Thus, as compared with a conventional heat exchanger provided with an offset inner fin, it is possible to realize improved performance of the condenser.

In addition, the condenser of the present embodiment uses the inner fin 46 to obtain a disturbance effect for the refrigerant, so that there is no fear that the contact area between the tube 22 and the corrugated fin 24 may decrease, as in the conventional heat exchanger in which the tube 22 is provided with a dimple. As a result, there is no decrease in the heat releasing performance. Naturally, there is also no fear that the brazing material accumulated at the dimple may scrape the outer wall of the tube 22 when flowing down, reducing the plate thickness of the tube 22.

Figure 11:
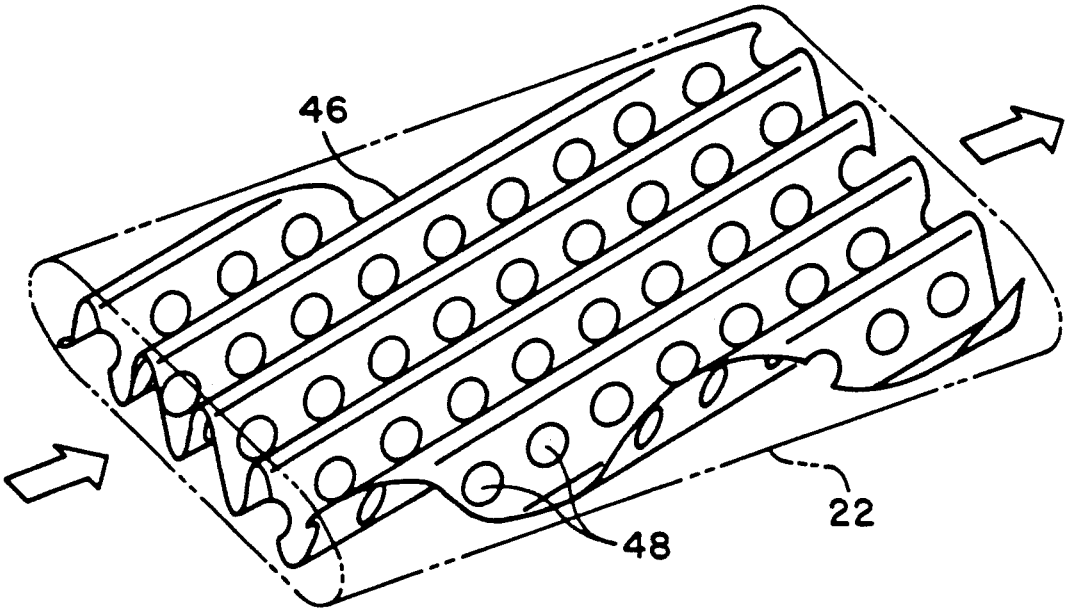
FIG. 11 is a perspective view of another inner fin.
Figure 12:
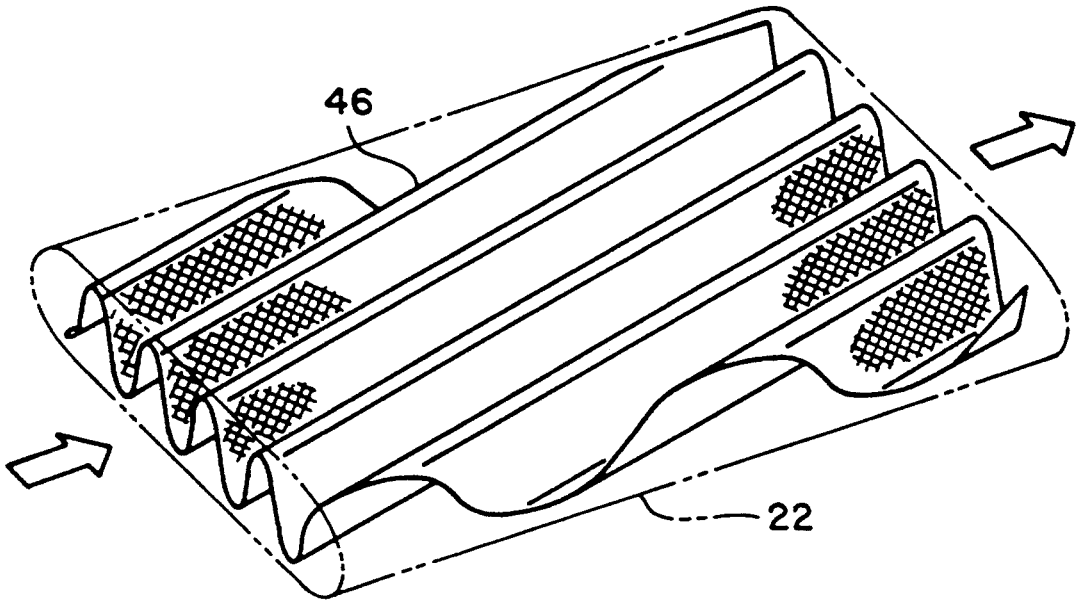
FIG. 12 is a perspective view of another inner fin.

An offset inner fin 46 has been used in the embodiment just described, however, as shown in FIG. 11, an inner fin 46 with a large number of communication holes 48 provided at the wall face of the adjacent refrigerant passages 44 may be used. Alternatively, as shown in FIG. 12, an inner fin 46 formed with a mesh of metal material such as wire netting may be used.

In order to obtain the disturbance effect of the refrigerant flowing in the tube 22, each fluid passage 44 formed in the tube 22 has a inclination of a predetermined angle $\theta$ with respect to the longitudinal direction of the tube 22, however, in order to enhance the disturbance effect, the vicinity of the angle $\theta=45$ degrees is considered to be most suitable. However, the larger the angle $\theta$, namely the more inclined the fluid passage 44 is with respect to the longitudinal direction of the tube 22, the higher the pressure loss becomes, so that even when the angle $\theta$ is set at 45 degrees, it does not necessarily coincide with the maximum value of the condensation performance of the refrigerant condenser.

In order to enhance the inserting property during the insertion of the inner fin 46 into the tube 22, the inner fin 46 may be also suitably cut in the longitudinal direction of the tube 22 so as to be successively inserted.

Figure 13:
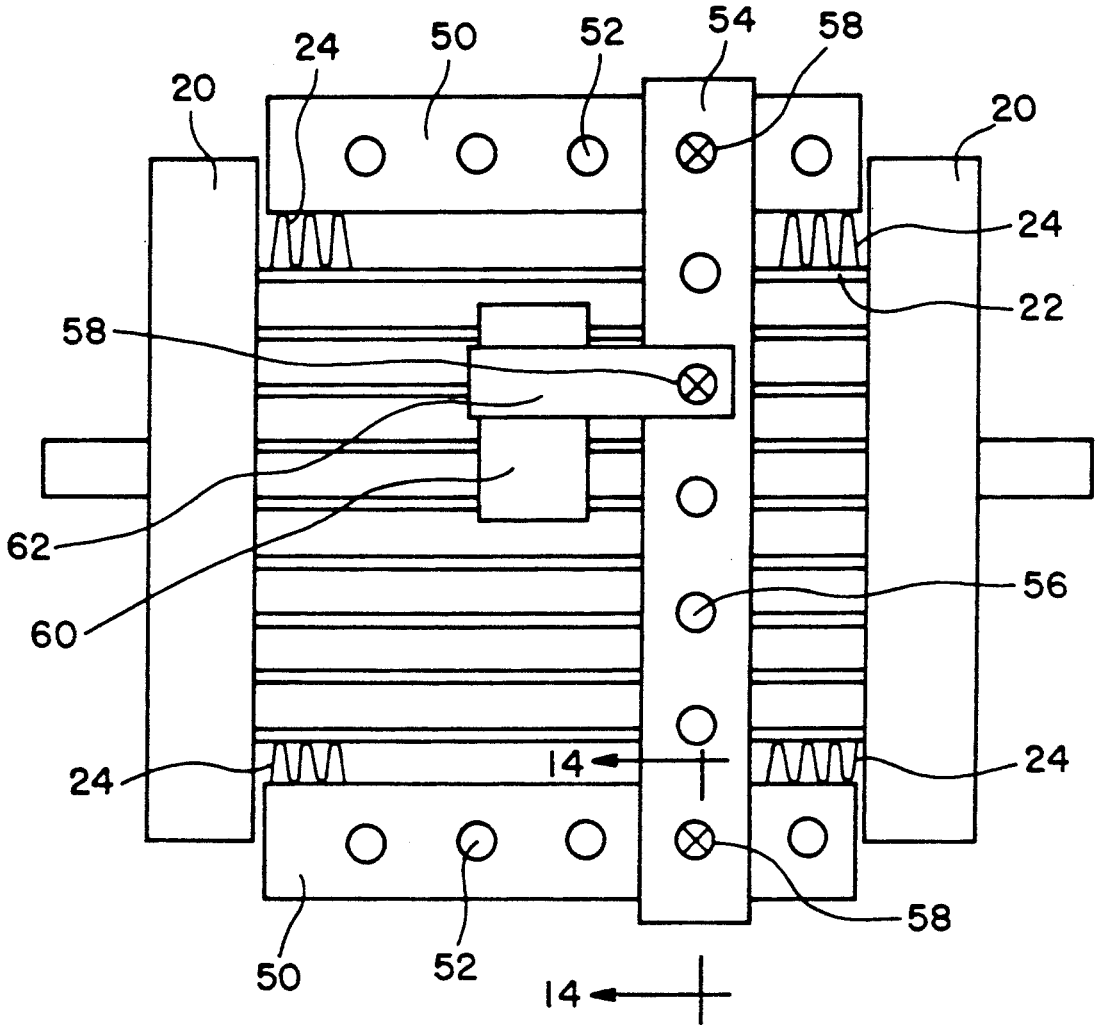
FIG. 13 is a front view of a condenser.

The core portion of the multi-flow condenser is composed of a plurality of oblate shape tubes which have a width, in the perpendicular direction of the drawing, shorter than a width in the upper to lower direction of the drawing, so that it is easily deformed by the external force or the internal force. In order to prevent deformation, and as an assembling jig before the calcination of the core, a general multi-flow condenser has an attachment member arranged at the corner of the core portion. As shown in FIG. 13, the condenser of the present embodiment is also arranged with a side plate 50 as the attachment member at two corners of the core portion. In addition, the side plate 50 is provided with a plurality of holes 52.

In order to cross-link both side plates 50, a sub-bracket 54 as a cross-linking member is arranged. The sub-bracket 54 is provided with a plurality of holes 56, with the size of the hole 56 being equal to the size of the hole 52 provided at the side plate 50. Among the plurality of holes 56 provided at the sub-bracket 54, the holes 56 at both ends and the holes 52 provided at the side plate 50 are put upon one another, and fixed by inserting a pin 58.

Figure 14:
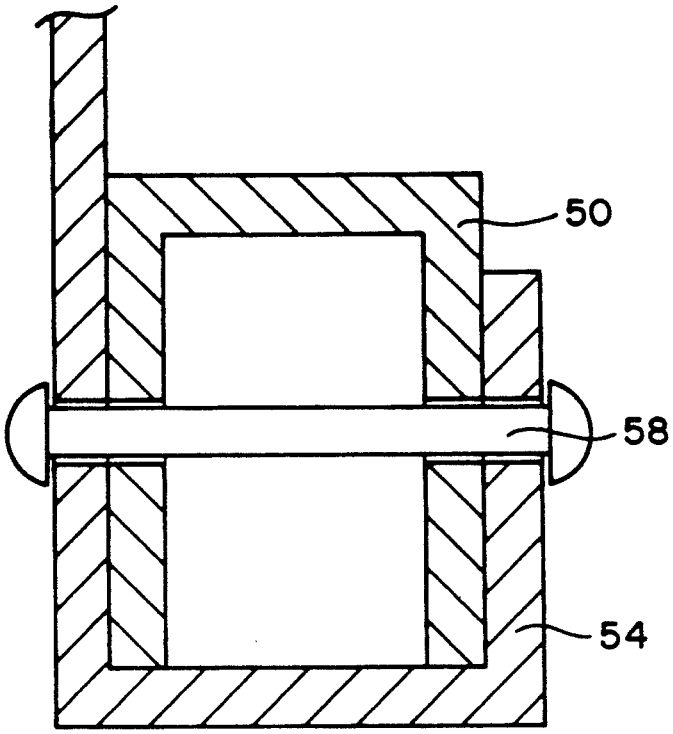
FIG. 14 is a cross sectional view taken along a line 14—14 in FIG. 13.

In this case, in order to show the coupling relationship between the side plate 50 and the sub-bracket 54, a partial cross-sectional view taken along a line 14—14 in FIG. 11 is shown in FIG. 14. As shown in FIG. 14, the side plate 50 has a U shaped cross-section, and the sub-bracket 54, also having a U shape, is coupled so as to surround the outside of the side plate 50. The hole 52 of the side plate 50 and the hole 56 of the sub-bracket 54 are put upon one another, and the pin 58 is inserted. After the pin 58 is inserted into the hole, both the right and left ends in FIG. 14 are caulked and fixed.

A receiver 60, which temporarily stores the refrigerant liquefied by the condenser composed of the header 20, tube 22 and fin 24, is held at the other end of a holder 62 having one end fixed to the sub-bracket 54. Regarding the fixing method for the holder 62 and the sub-bracket 54, a hole having the same size as that of the hole provided at the sub-bracket 54 is provided at the holder 62, and both holes are put upon one another and the pin 58 is inserted, and then both ends of the pin 58 are caulked and fixed.

Since the sub-bracket 54, which fixes the holder 62, is fixed to the two side plates 50, it has a stronger vibration resistance than that of the receiver attachment structure by cantilever beam as shown. In addition, the shorter the length of the holder 62, the stronger the vibration resistance becomes at the fixing position between the holder 62 and the sub-bracket 54.

Because a plurality of holes are provided at the side plate 50 and the sub-bracket 54, the position where the receiver 60 is attached can differ depending on vehicle types and the layout of the engine. The receiver 60 can be attached at various positions by optionally selecting a fixed position between the side plate 50 and the sub-bracket 54, and a fixed position between the holder 62 and the sub-bracket 54.

In addition, the sub-bracket 54 is provided with a plurality of holes so that the resistance of air which passes through the core portion becomes less, resulting in the acceleration of heat exchange between the refrigerant and the air.

In addition, in the present embodiment, the side plate 50 being a necessity for the condenser is used as the attachment member. Without separately providing an attachment member, the necessary side plate 50 can be cleverly used as the attachment member, so that there is no increase in cost.

Figure 15:
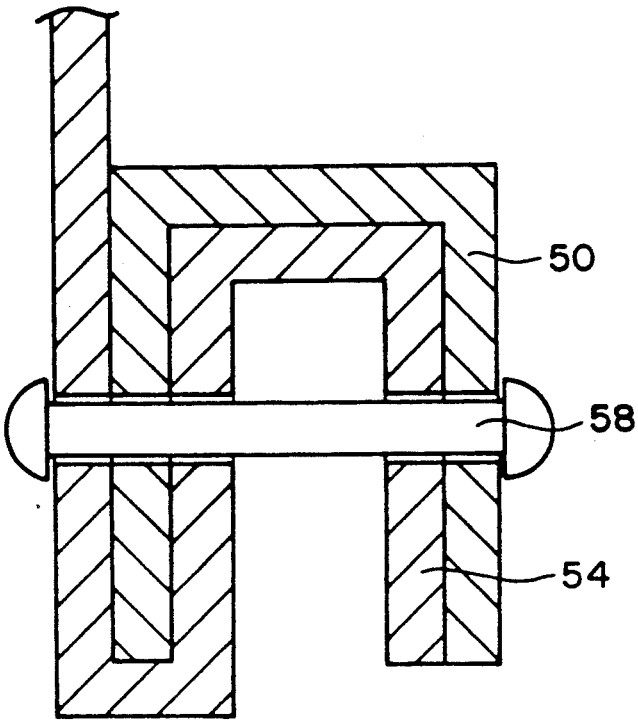
FIG. 15 is a cross sectional view showing another modification corresponding to FIG. 14.

It is possible, as shown in FIG. 15, that the sub-bracket 54 is coupled with the side plate 50 along the inner face of the side plate 50, and the pin 58 is inserted into the hole so as to fix by caulking both ends of the pin 58.

Figure 16:
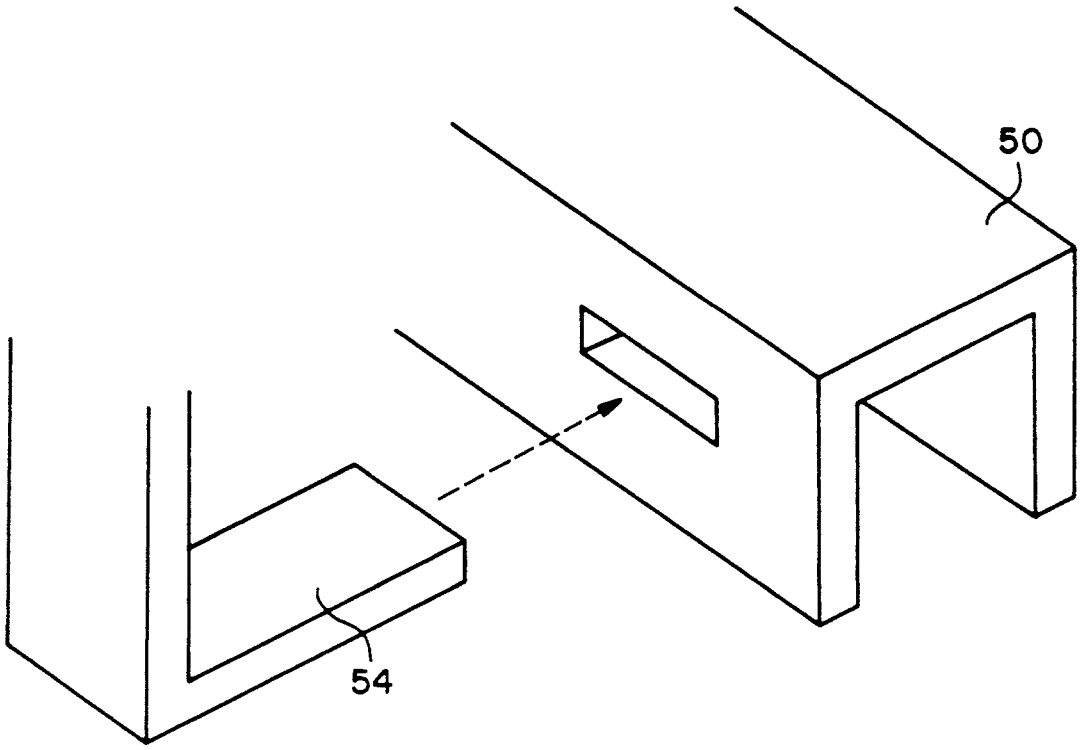
FIG. 16 is a perspective view showing another modification corresponding to FIG. 14.

Alternatively, other than the use of the pin 58 as the fixing method between the side plate 50 and the sub-bracket 54, as shown in FIG. 16, the end portion of the sub-bracket 54 may be directly inserted into the side plate 50, and caulked and fixed.

Figure 17:
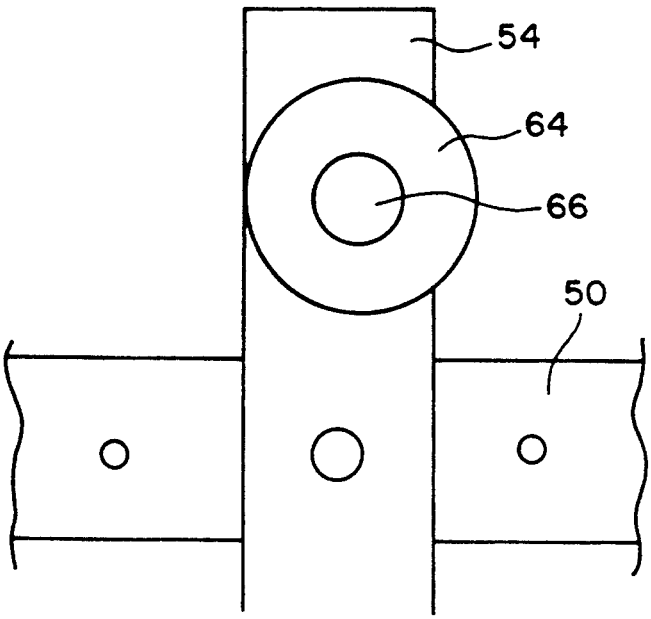
FIG. 17 is a partial front view showing another modification corresponding to FIG. 14.

Alternatively, it is also possible, as shown in FIG. 17, that the length of the sub-bracket 54 is made such that the sub-bracket 54 protrudes from the core portion a little, and a hole is opened at a portion protruding from the core portion of the sub-bracket 54 so as to install a grommet 64 on the hole, fixed with a screw 66. By doing so, it becomes unnecessary to separately provide a part for attaching the condenser main body to the vehicle body.

What is claimed is:

1. A heat exchanger, comprising;

a pair of headers constituted by a longitudinal tank member which has a transverse cross-section having a predetermined curvature and a tube attachment member which is joined in the longitudinal direction opposing to the tank member; and a tube communicating between the headers to allow a refrigerant flowing therethough, the tank member being provided with (a) a brazing material layer provided at least at a joining face with respect to the tube attachment member, and (b) a plane portion formed at an inner peripheral face adjacent to the joining face with respect to the tube attachment member, the tube attachment member being provided with (a) a brazing material layer provided at least at a joining face with respect to the tank member, (b) a plane portion formed at an inner peripheral face adjacent to the joining face with respect to the tank member, (c) a first curvature portion which is formed in the vicinity of the joining face with respect to the tank member and has a predetermined curvature, and (d) a second curvature portion which is formed at a central portion interposed between both sides by the first curvature portion and has a curvature larger than that of the curvature portion of the tank member, and a connecting position between the first curvature portion and the second curvature portion of the tube attachment member being positioned inside of an attachment region of the tube to be attached to the tube attachment member.

2. The heat exchanger according to claim 1, wherein the first curvature portion of the tube attachment member has approximately the same curvature as that of a curvature portion of said tank member.

3. The heat exchanger according to claim 1, wherein the tube is formed with a plurality of fluid passages at its interior, and the fluid passages have circular transverse cross-sectional shapes.

4. The heat exchanger according to claim 1, further comprising;

inner fins for forming a plurality of fluid passages in the tube, the inner fins being inserted into the tube such that the fluid passages have an inclination of a predetermined angle with respect to the longitudinal direction of said tube.

5. The heat exchanger according to claim 4, wherein the inner fin has plurality of communication holes which are provided at wall faces of said adjoining fluid passages so as to allow said fluid passages to communicate in the longitudinal direction of the tube respectively.

* * * * *